US007377885B2

(12) United States Patent
Doudiet

(10) Patent No.: US 7,377,885 B2
(45) **Date of Patent: *May 27, 2008**

(54) DUMBBELL ADJUSTING SYSTEM METHOD

(75) Inventor: Adam T. Doudiet, San Francisco, CA (US)

(73) Assignee: ATD Services, Inc., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/584,684

(22) Filed: Oct. 19, 2006

(65) Prior Publication Data

US 2007/0037675 A1 Feb. 15, 2007

Related U.S. Application Data

(62) Division of application No. 11/301,812, filed on Dec. 12, 2005, now Pat. No. 7,137,932.

(60) Provisional application No. 60/635,876, filed on Dec. 13, 2004.

(51) Int. Cl.
*A63B 21/075* (2006.01)

(52) U.S. Cl. ..... 482/107; 482/98; 482/108

(58) Field of Classification Search ..... 482/106–109, 482/98

See application file for complete search history.

(56) References Cited

U.S. PATENT DOCUMENTS

| | | | | |
|---|---|---|---|---|
| 1,672,944 | A | 6/1928 | Jowett | |
| 5,090,693 | A | 2/1992 | Liang | |
| 5,221,244 | A | 6/1993 | Doss | |
| 5,464,379 | A | 11/1995 | Zarecky | |
| 5,628,716 | A | 5/1997 | Brice | |
| 5,669,861 | A * | 9/1997 | Toups | 482/98 |
| 5,839,997 | A | 11/1998 | Roth et al. | |
| 5,876,313 | A * | 3/1999 | Krull | 482/98 |
| 6,117,049 | A * | 9/2000 | Lowe | 482/4 |
| 6,149,558 | A | 11/2000 | Chen | |
| 6,500,101 | B1 | 12/2002 | Chen | |
| 6,540,650 | B1 | 4/2003 | Krull | |
| 7,014,598 | B2 | 3/2006 | Fenelon et al. | |
| 7,121,988 | B2 * | 10/2006 | Walkerdine | 482/106 |
| 7,137,932 | B2 * | 11/2006 | Doudiet | 482/107 |
| 7,261,678 | B2 * | 8/2007 | Crawford et al. | 482/107 |
| 2003/0096683 | A1 | 5/2003 | Fenelon et al. | |
| 2003/0148862 | A1 | 8/2003 | Chen et al. | |
| 2004/0005968 | A1 | 1/2004 | Crawford et al. | |
| 2005/0233873 | A1 | 10/2005 | Chen | |
| 2007/0184945 | A1 * | 8/2007 | Lin | 482/107 |
| 2007/0254785 | A1 * | 11/2007 | Lin | 482/108 |

FOREIGN PATENT DOCUMENTS

| | | |
|---|---|---|
| WO | WO 0158533 A2 * | 8/2001 |

* cited by examiner

*Primary Examiner*—LoAn H. Thanh
*Assistant Examiner*—Victor K. Hwang
(74) *Attorney, Agent, or Firm*—Townsend and Townsend and Crew LLP

(57) ABSTRACT

A dumbbell adjusting system method comprises an adjusting system, a stand, and a locking mechanism. The adjusting system includes two rods on the dumbbell's handle which move in and out of the handle to selectively engage the inner threaded through holes of the weights. The weights are configured to interlock with one another so as not to move independently. The locking mechanism unlocks the weights from the handle when the dumbbell is in the stand, allowing the user to select the desired weight, and locks the weights into the handle when the dumbbell is lifted out of the stand.

8 Claims, 12 Drawing Sheets

DUMBBELL ADJUSTING SYSTEM METHOD

CROSS-REFERENCES TO RELATED APPLICATIONS

This application is a divisional of U.S. application Ser. No. 11/301,812, filed Dec. 12, 2005 now U.S. Pat. No. 7,137,932 B2, which claimed the benefit of provisional application No. 60/635,876, filed on Dec. 13, 2004, the full disclosure of which is incorporated herein by reference.

BACKGROUND OF THE INVENTION

1. Field of the Invention

The present invention relates generally to an exercise device. and more particularly to an adjustable dumbbell.

U.S. Pat. No. 6,500,101 discloses an adjustable dumbbell comprising two rotating rods that move into and out of through holes of weights by means of a selection knob mounted on a carrying seat. The weights are held by the carrying seat by means of two connection rods held between the weights on opposite ends of the dumbbell.

The connection rods, the four grip rods around the central handle, and the selection device mounted on the carrying seat make the dumbbell bulky and cumbersome to use. They also limit flexibility in the user's wrist which is a problem in exercises that stimulate the forearm. Lastly, the bulkiness detracts from the traditional aesthetic look of a regular dumbbell of a handle and weights on the ends.

2. Description of the Background Art

Adjustable dumbbell systems are described in U.S. Pat. Nos. 5,090,693; 5,464,379; 5,628,716; 6,149,558; and 6,500,101; and U.S. Published Application No. 2003/0148862.

BRIEF SUMMARY OF THE INVENTION

The present invention selectively engages and releases weights from a tube with two inner rods without a carrying seat making it safer to use and allowing for full mobility. It comprises of 1) an adjusting system, 2) a stand, and 3) a locking mechanism. The adjusting system relies on rotating the dumbbell's handle which then moves the rods in and out of the handle and engages/disengages through holes of the weights. The locking mechanism unlocks the weights from the handle when the dumbbell is lowered into the stand and prevents the dumbbell from being lifted from the stand until the desired number of weights are fully loaded.

In a first aspect, the present invention comprises a dumbbell system which allows for a particularly convenient mechanism for user weight adjustment. The mechanism can be adjusted with a single hand and allows the user to effect adjustment in a single motion immediately prior to lifting the weight from an associated storage stand. The dumbbell system comprises a tube having an inner axial passage and outer surface adapted for manual grasping. The tube will serve as the handle for the dumbbell, and will have a pair of externally threaded rods mounted to axially translate in opposite directions from openings at either end of the tube handle. The rods will be mounted so that they will rotate in response to rotation of the handle (typically being coupled by slotted stop ends which ride on an adjustment rail formed on the inner surface of the tube handle), and a plurality of weights having threaded center holes will be disposed at either end of the tube handle. The weights will be arranged successively and held, usually in the associated stand, so that rotation of the tube will selectively cause each of the rods to engage the threaded center holes and advance into the center holes of the weights, typically by a distance which can be observed through a window on the tubular handle. In this way, the user can rotate the handle, such that and until each of the externally threaded rods enters the weights and engages the weights via the threads. When a desired number of weights have been engaged on each side, typically an equal number so that the dumbbell is symmetrically loaded, the user can stop rotating the handle and lift the dumbbell from the stand for use.

In preferred embodiments, the weights will have slots and strips which interlock with each other so that adjacent weights cannot rotate relative to each other. The system will preferably further comprise the stand, and the stand will be adapted to receive and immobilize the weights while the tube is being rotated within the dumbbell system. The system will further preferably comprise a locking mechanism including a spring and a bullet for engaging an inside weight to prevent rotation of the plurality of weights when the dumbbell is out of the stand and in use.

In another aspect of the present invention, a method for adjusting the weight on each end of the dumbbell comprises providing a dumbbell having a tube handle and a plurality of weight on each end. The weights are adjusted by turning the tube handle to axially advance or retract rods from the handle into each of the plurality of weights such that the number of weights engaged by the rods is always the same on each end of the handle. In this way, the user can rotate the handle until a desired number of weights are engaged and then lift the handle from an associate stand or other receptacle for use.

DETAILED DESCRIPTION OF THE INVENTION

Figure 1:
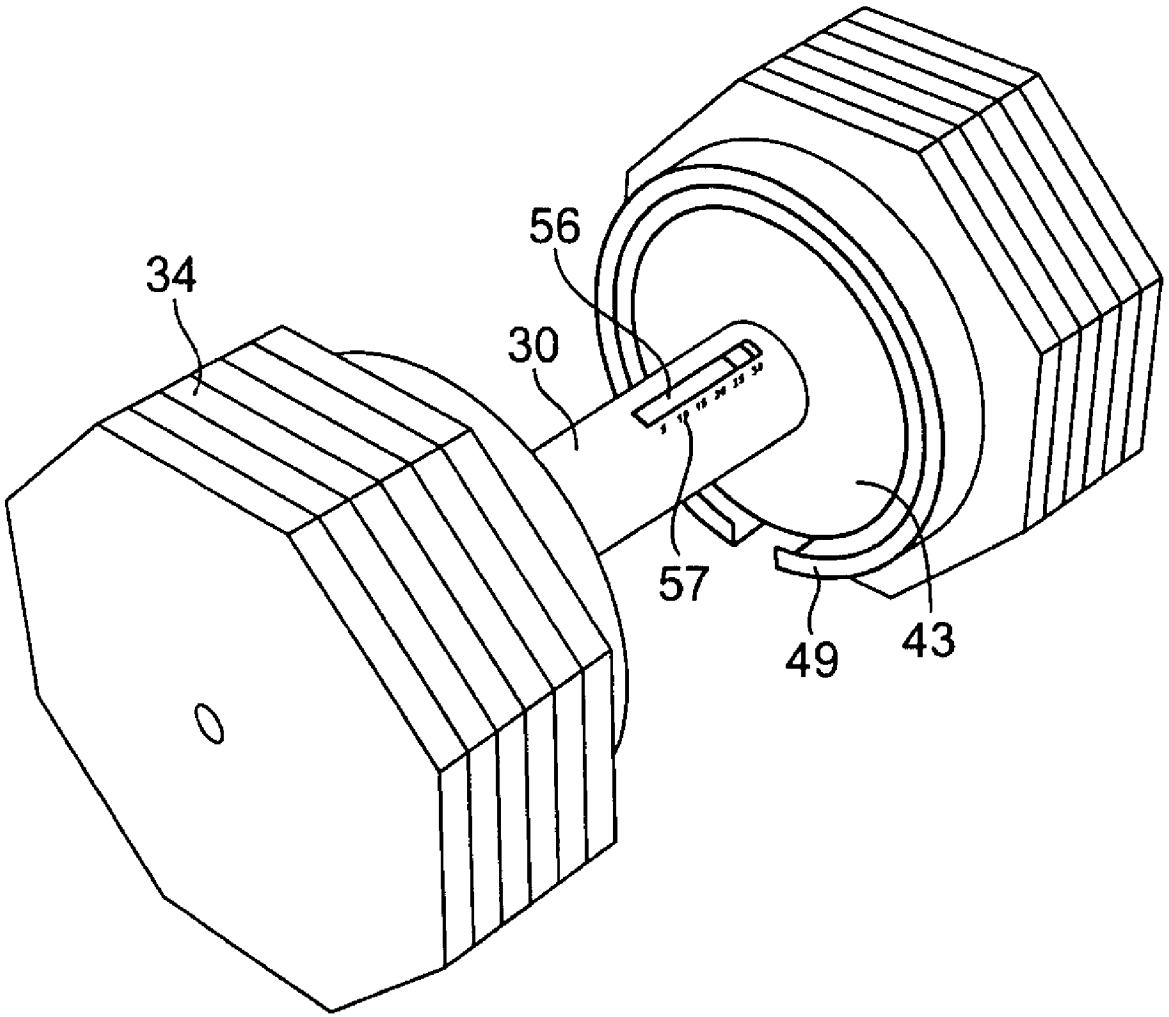
FIG. 1 is an overview of the dumbbell.
Figure 4:
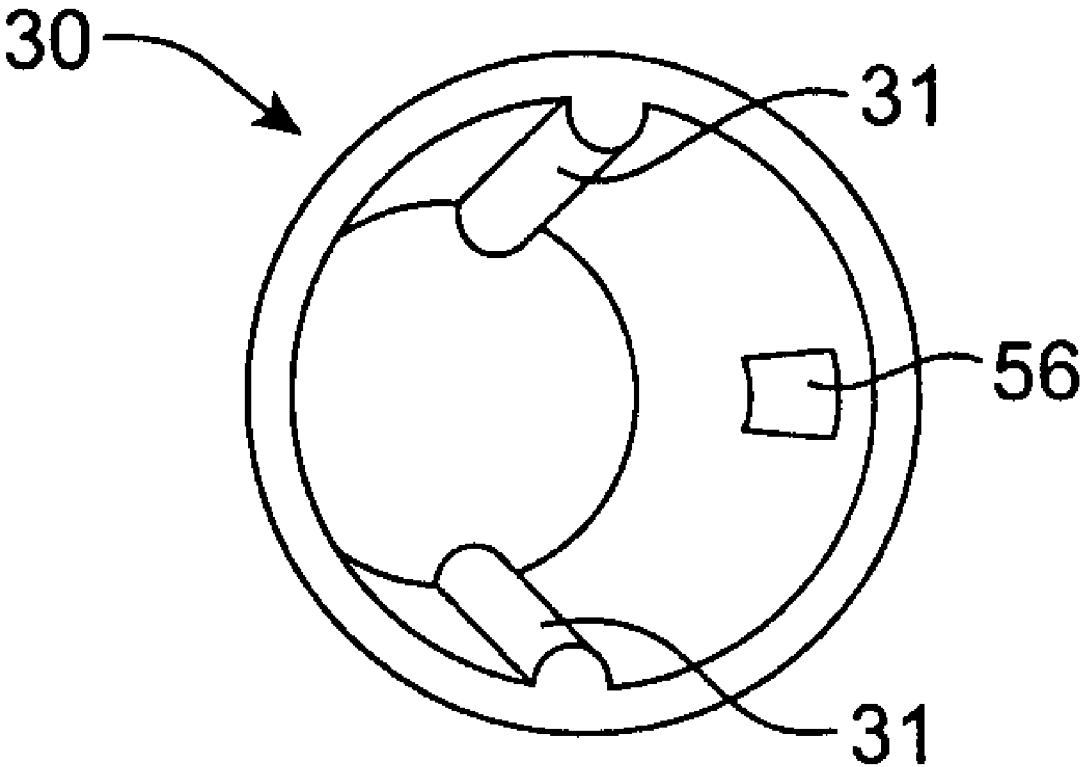
FIG. 4 is a view of the tube from end.
Figure 5:
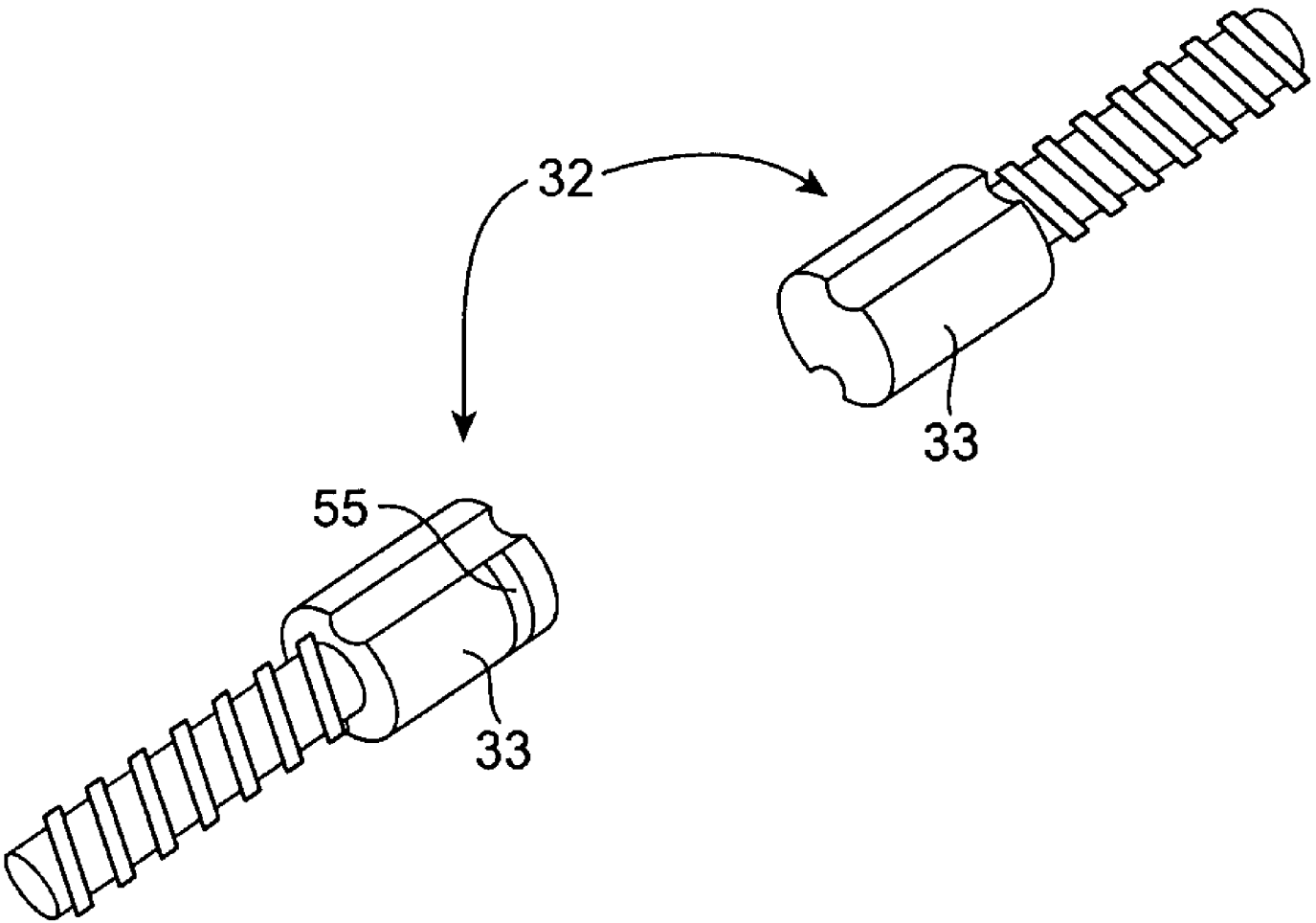
FIG. 5 are rotary rods.
Figure 6B:
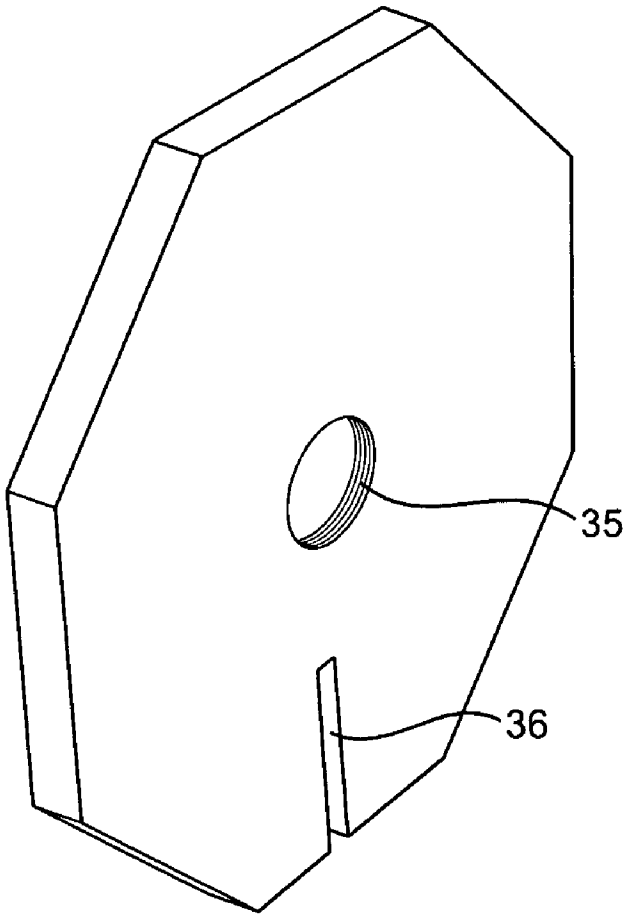
FIG. 6*b* is a view of the outside surface of weight.
Figure 6A:
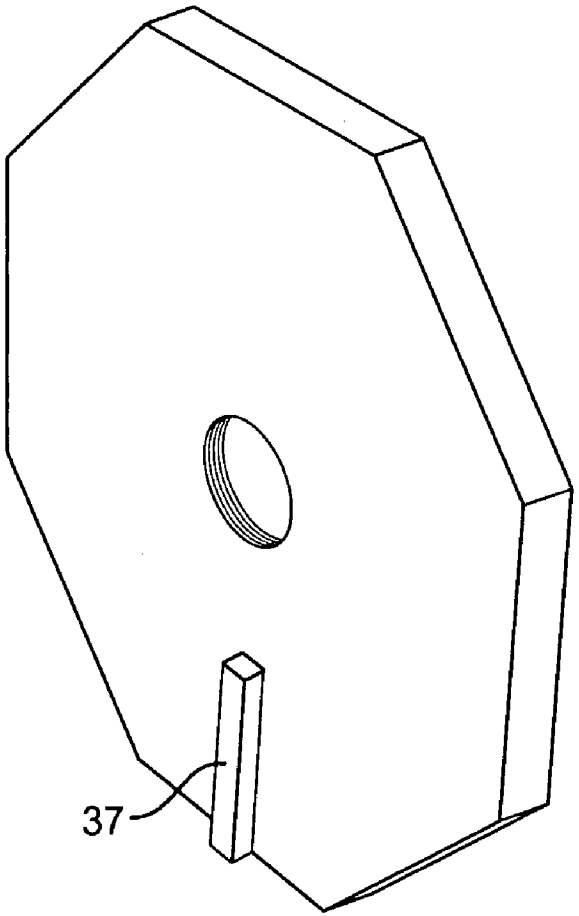
FIG. 6*a* is a view of the inside surface of weight.

A tube 30 (FIGS. 1 and 4) has one or more rails 31 attached lengthwise along an inside surface of the tube. Two rotating rods 32 with stop ends 33 are conformed to fit inside an axial passage in the tube 30. The passage preferably has a non-circular cross-section which conforms to the outer periphery of the stop ends 33. An indicator line 55 on the stop end 33 (FIG. 5) of either of the two rotary rods 32 appears through a display window 56 in the tube 30. The indicator line 55 moves axially to selection numbers 57 that appear alongside the display window 56 on the outside surface of the tube 30 as the tube is manually rotated, as described in more detail below. Weights 34 with internally threaded through holes 35 are engaged by the rotary rods 32. At least one weight on each end of the tube 30 is engaged at all times. The outside surface of each weight, with the exception of the outside weights furthest from the tube 30, has a slot 36 (FIG. 6*b*). The inside surface of each weight, with the exception of the inside weights closest to the tube 30, has a strip 37 (FIG. 6*a*). The strips 37 of each weight fit into the slots 36 of the next weight to couple adjacent weights so that each weight engaged by the rotary rods 32 cannot move independently of each other. In addition, there is a hole 38 (FIG. 3) on the inside surface of each of the inside weights.

Figure 3:
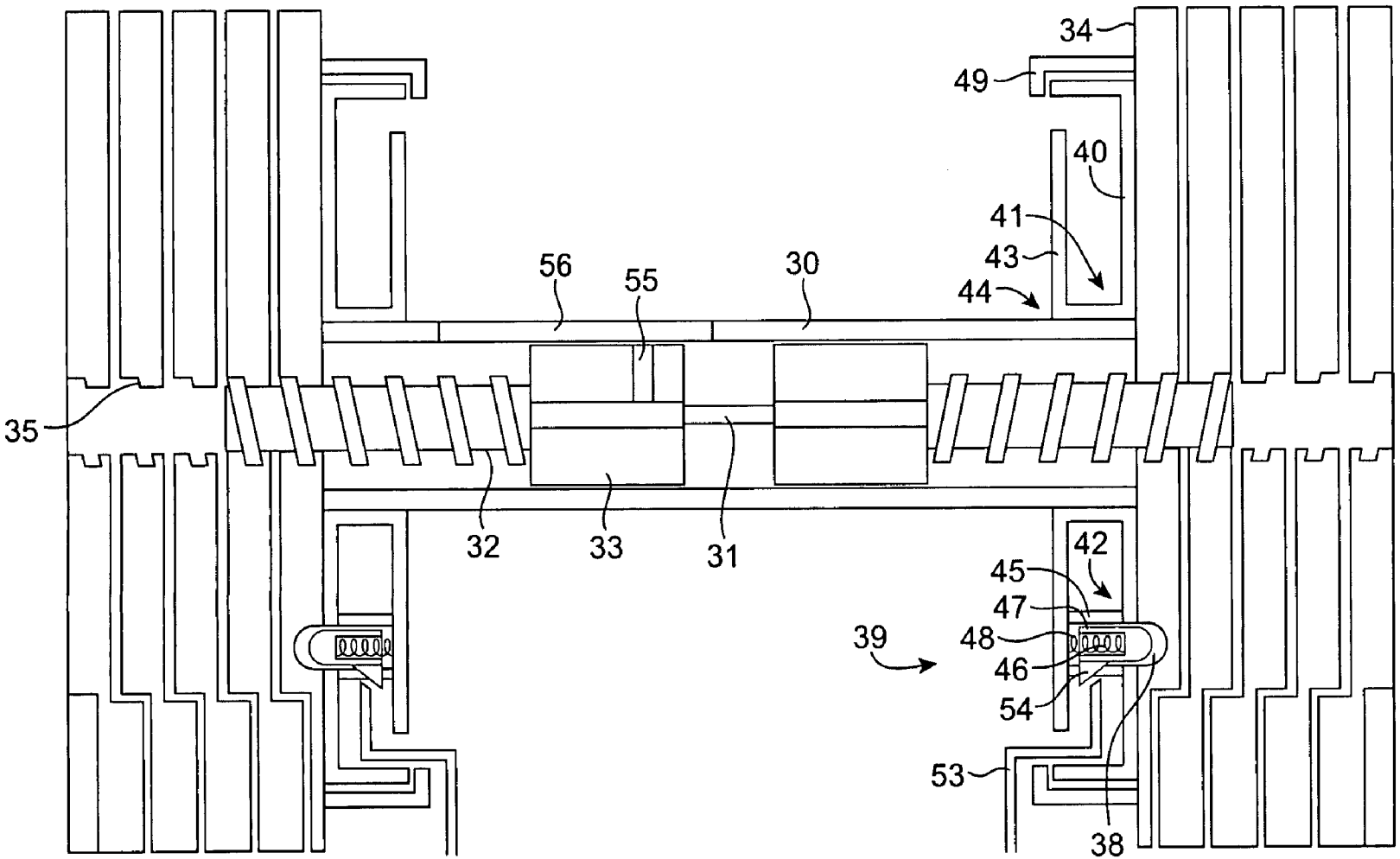
FIG. 3 is a sectional view of the dumbbell.
Figure 7:
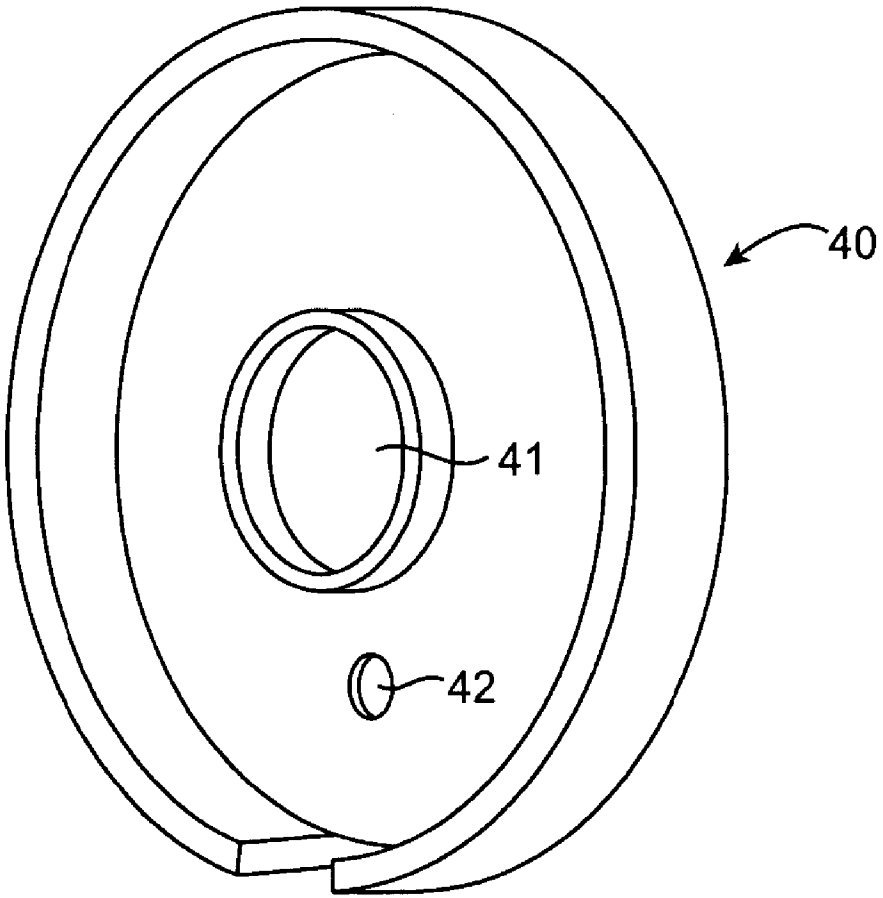
FIG. 7 is an inside view (facing toward handle) of the first half of locking structure.
Figure 8:
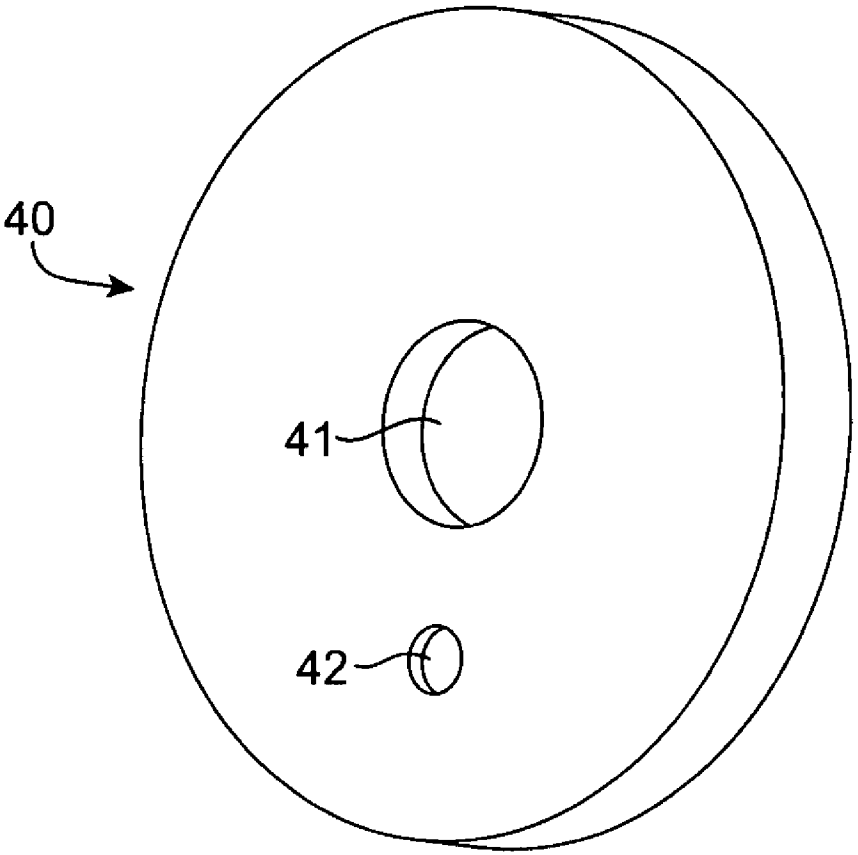
FIG. 8 is an outside view (facing away from handle) of the first the half of locking structure.
Figure 9:
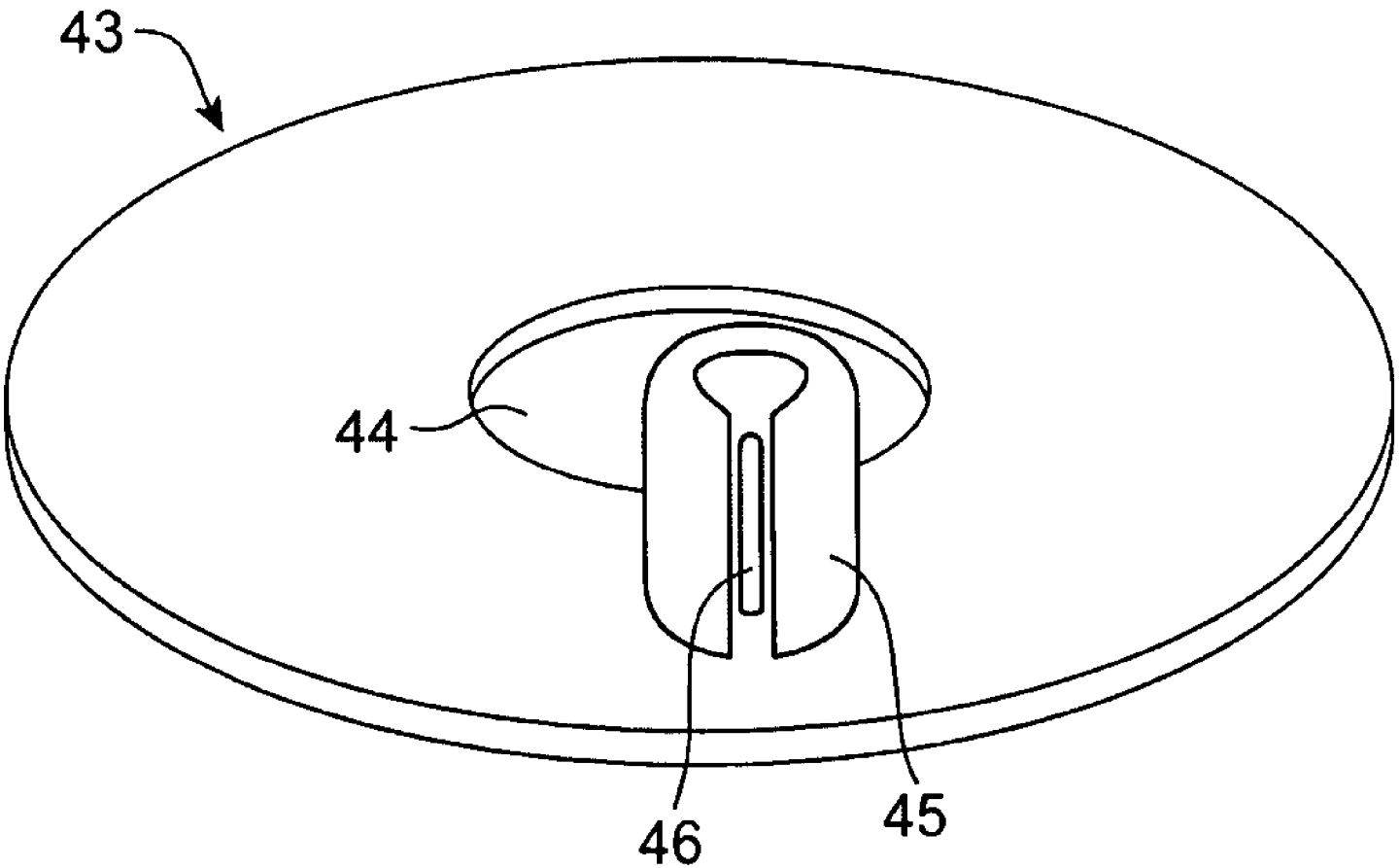
FIG. 9 is an outside view (facing away from handle) of the second half of locking structure.
Figure 10:
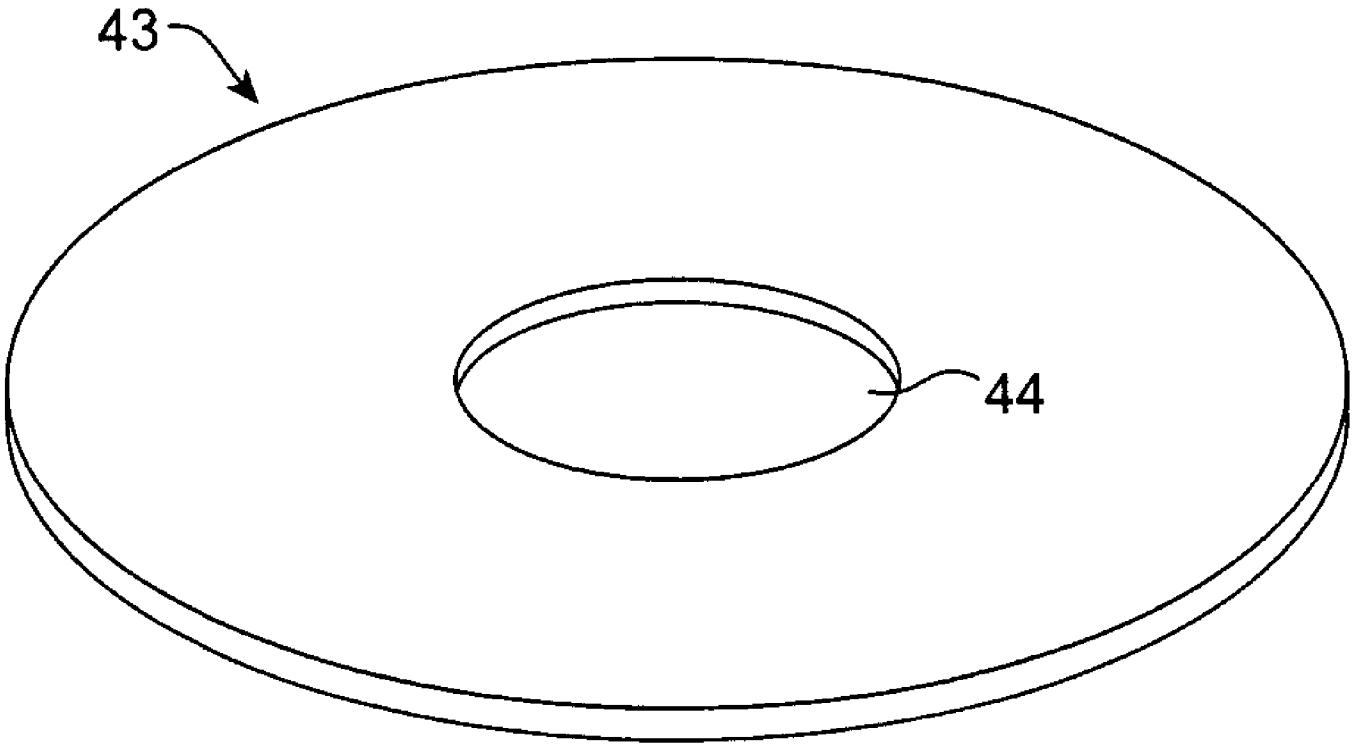
FIG. 10 is an inside view (facing toward handle) of the second half of locking structure.

A locking structure 39, as shown in FIG. 3, is attached to each of the outer ends of the tube 30. The locking structure 39 consists of two halves. One half 40 contains a hole 41 (FIGS. 7 and 8) through which to fit the tube 30 and a second hole 42 (FIG. 8) through which a locking bullet 47 enters the hole 38 in the inside weight. The other half 43 (FIG. 10) contains a hole 44 (FIG. 9) through which to fit the tube 30 and a container 45 and pin 46 (FIG. 3) to guide the locking bullet 47 and a spring 48.

Figure 12:
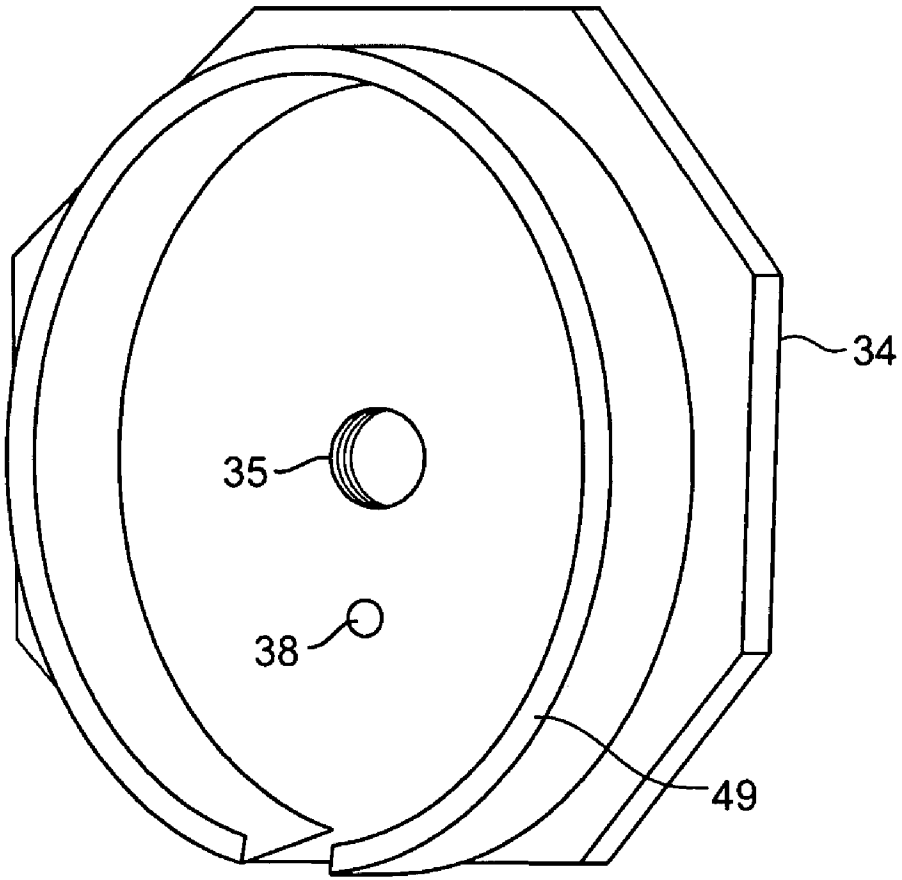
FIG. 12 is a retaining ring shown attached to the inside surface of weight.

Attached to the inside surface of the inside weights is a retaining ring 49 (FIG. 12) into which the locking structure 39 fits. The retaining ring 49 keeps the inside weights from separating from the tube 30 at all times.

Figure 2:
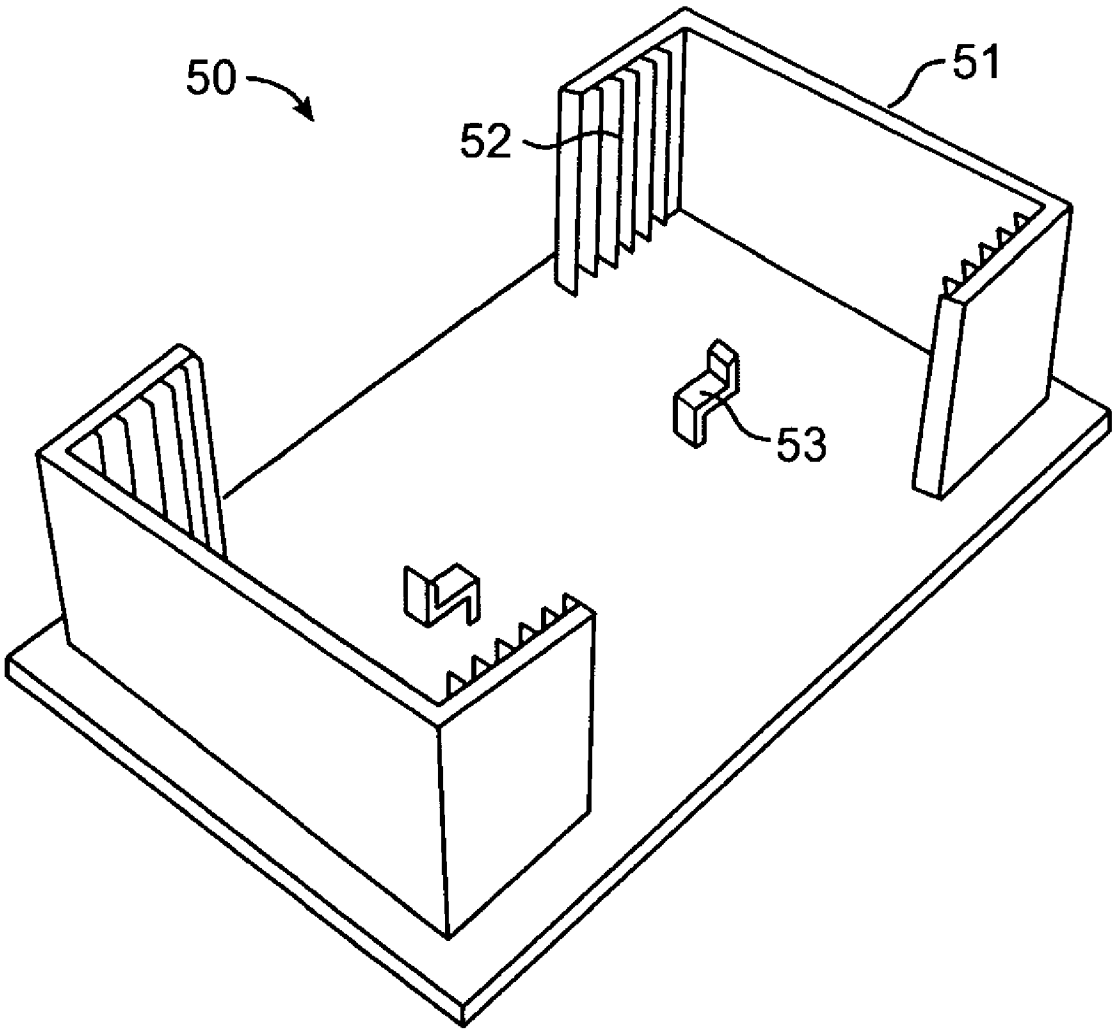
FIG. 2 is an overview of the stand.

A stand 50 (FIG. 2) comprises two compartments or brackets 51 to hold the two sets of weights (one on each end of the dumbbell). The compartments 51 contain retaining fins 52 which define slots to receive and to maintain the weights 34 upright and parallel to each other. On the surface of the stand 50 are latches 53.

Figure 11:
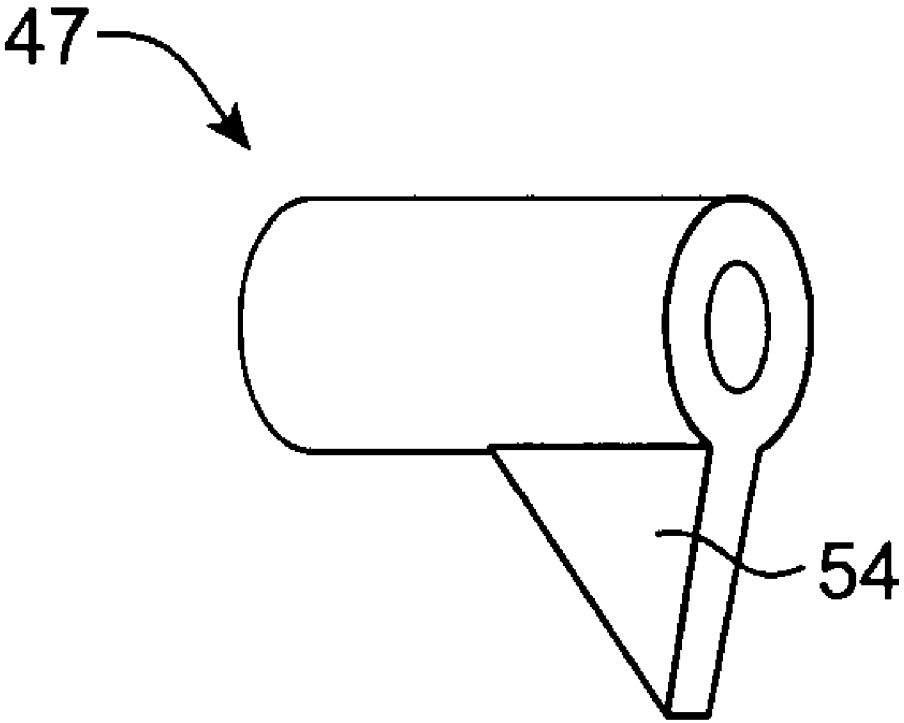
FIG. 11 are inserts into hole in bullet.

When the dumbbell is lowered into the stand 50 (FIG. 2), each latch 53 compresses the spring 48 (FIG. 3) by contacting the angled fin 54 on the locking bullet 47 (FIG. 11). This disengages the locking bullet 47 from the hole 38 of the inside weights so only the rounded head of the locking bullet 47 remains in the hole 38 and locking bullet 47 advances into the container 45. When the user rotates the tube 30, the locking bullet 47 further advances into the container 45 and fully disengages the hole 38 in the inside weight. The latch 53 (FIG. 3) is also enclosed by the locking structure 39, restricting the dumbbell from being lifted until the tube 30 has made one complete rotation. When the tube 30 is rotated, the rotary rods 32 also rotate by force of the rails 31 and the non-circular geometry of the stop ends 33 and engage or disengage the through holes 35 of the weights 34.

What is claimed is:

1. A method for adjusting the weight of each end of a dumbbell, said method comprising:

providing a dumbbell including a tube handle and a plurality of weights on each end; and turning the tube handle to axially advance or retract rods into each of the plurality of weights, wherein the number of weights engaged by the rods is always the same on each end; and wherein the rods axially rotate to selectively engage the weights.

2. A method for providing user selected weight in a dumbbell system, comprising:

providing a dumbbell system including a tube handle with two ends and axial rods extending from each end, the dumbbell system configured for engaging with a plurality of weights at each end thereof;

axially rotating the handle;

engaging the handle and the weights;

wherein axially rotating the handle axially rotates the axial rods to selectively engage the weights.

3. The method according to claim 2, wherein the system further comprises a locking mechanism including a spring and a bullet, wherein the engaging step comprises the bullet engaging the handle and at least one weight.

4. The method according to claim 3, wherein the bullet engaging step comprises advancing the bullet into at least one weight.

5. The method according to claim 2, wherein axial rods are threaded rods, and the engaging step comprises threading each rod with at least one weight.

6. The method according to claim 5, wherein engaging step comprises threading each rod into at least one weight.

7. A method for providing user selected weight in a dumbbell system, comprising:

providing a dumbbell system including a tube handle with two ends and axial rods extending from each end, the dumbbell system configured for engaging with a plurality of weights at each end thereof;

axially rotating the handle;

engaging the handle and the weights;

wherein the system further comprises a locking mechanism including a spring and a bullet, wherein the engaging step comprises the bullet engaging the handle and at least one weight; and wherein the bullet engaging step comprises advancing the bullet into the handle.

8. A method for providing user selected weight in a dumbbell system, comprising:

providing a dumbbell system including a tube handle with two ends and axial rods extending from each end, and a plurality of weights at each end thereof;

axially rotating the handle;

engaging the handle and the weights;

wherein axially rotating the handle axially rotates the axial rods to selectively engage the weights.

* * * * *